United States Patent [19]

Peterson

[11] Patent Number: 4,690,316

[45] Date of Patent: Sep. 1, 1987

[54] QUICK RELEASE RETENTION OF WORK PIECES

[76] Inventor: Dennis P. Peterson, P.O. Box 15809, Arlington, Va. 22215

[21] Appl. No.: 849,270

[22] Filed: Apr. 8, 1986

[51] Int. Cl.[4] ..... A45F 5/00

[52] U.S. Cl. ..... 224/253; 224/901; 224/904; 224/270

[58] Field of Search ..... 224/901, 252, 904, 253, 224/242, 270, 149, 163

[56] References Cited

U.S. PATENT DOCUMENTS

| | | | |
|---|---|---|---|
| 2,588,467 | 3/1952 | Barney | 224/149 |
| 2,635,246 | 4/1953 | Olson | 224/149 X |
| 3,374,508 | 3/1968 | Slimovitz | 224/901 X |
| 3,708,801 | 1/1973 | Davis | 224/149 X |
| 3,760,461 | 9/1973 | Wright | 224/901 X |
| 4,140,253 | 2/1979 | Vickers et al. | 224/901 X |
| 4,345,704 | 8/1982 | Boughton | 224/901 X |
| 4,403,366 | 9/1983 | Lucke | 224/901 X |
| 4,448,560 | 5/1984 | Monaco, Jr. | 224/901 X |
| 4,561,577 | 12/1985 | Moore | 224/253 X |
| 4,562,620 | 1/1986 | Oliver, Jr. | 224/163 X |
| 4,572,415 | 2/1986 | Fehr | 224/253 |

*Primary Examiner*—Henry J. Recla
*Assistant Examiner*—Robert M. Petrik
*Attorney, Agent, or Firm*—George E. Kersey

[57] ABSTRACT

Method and apparatus for providing quick release retention of work pieces. A receptor that is attachable to a user includes a mechanism for attaching the work piece to the receptor by contact. The receptor is provided with a guard structure to protect against accidental release, without inhibiting quick release when desired.

10 Claims, 6 Drawing Figures

QUICK RELEASE RETENTION OF WORK PIECES

BACKGROUND OF THE INVENTION

This invention relates to the quick release retention of work pieces, and more particularly to the quick release retention of tape measures.

A tape measure is formed by a narrow strip of a flexible material, such as steel or plastic, that is marked with unit of length. It is commonly housed in a square or retangular container. When the user wishes to employ the device to make a measurement, the end of the tape is withdrawn from the container and the measurement is made. Once the measurement has been completed, the end is returned to the container. For some housings, there is an internal spring that effects automatic return or retraction of the extended portion of the tape into the housing.

In any case it is common practice for the tape measurement unit to be misplaced. The measurement unit is frequently required. After it is employed it is commonly placed in the work area and the user moves on to another location. When he looks for his tape measure he generally finds that he does not have it and he has to spend a great deal of time in attempting to locate it.

Accordingly it is an object of the invention to facilitate the convenient storage of work pieces. A related object is to facilitate the convenient storage of work pieces such as tape measures.

Another object of the invention is to provide for storage of the work piece on the person of the user. A related object is to provide for storage of tape measures on the person of the user.

Still another object of the invention is to provide for the quick release of a work piece that is retained on the person of a user. A related object is to provide for a quick release of a work piece that is of a tape measure that is retained temporarily on the person of the user.

SUMMARY OF THE INVENTION

In accomplishing the foregoing and related objects, the invention provides a quick release retainer for work pieces such as tape measures by a receptor that is attachable to a user and includes means for attaching the work piece to the receptor by contact. The attachment is to an item of apparel such as a belt. Accordingly, the receptor can include a set of attachment loops on its reverse side. In addition, the receptor desirably includes a frontal face with a surface that is able to make engaging and secure contact with the work piece, by example, by an adherent medium. The adherent medium is engagable with a complementary medium, secured to the work piece, by a set of fabric hooks, and a complementary medium on the work piece is engagable by the fabric hooks. In accordance with a method of practicing the invention a work piece is removed from a receptor by applying tension between the receptor and the work piece through separation at one region between the work piece and the receptor. The work piece is then pivoted from the receptor, after the initial separation, while causing a progressive separation of the work piece from the receptor. The work piece is guarded against accidental separation from the receptor, for example by a partial rim of the receptor which partially encloses the work piece when positioned on the receptor. It is desirable for the guard to completely protect the base portion of the work piece and partly protect its adjoining sides. The guard extends from the base and partially on the adjoining sides, sloping gradually from the base to a point of connection on the receptor. The slope of the guard is desirably parabolic. This facilitates the removal of the work piece from the receptor and simultaneously guards against accidental removal. The guards desirably includes a lip along the base portion of the guard to protect against accidental removal of the work piece. The work piece is removable from the receptor by initial pivot, followed by elevation above the lip of the guard. The lip promotes the pivotal separation. A guard flange partially surrounds the base of the receptor and the base of the flange is curved to enhance the secure retention of the work piece in the receptor.

In the fabrication of a quick release retainer for a work piece, a support surface is provided. The support surface is partially enclosed by a guard structure and a retentive medium is applied to the support surface to permit the attachment of a work piece and its quick release.

DESCRIPTION OF THE DRAWINGS

Other aspects of the invention will become apparent after considering several illustrative embodiments taken in conjunction with the drawings in which.

DETAILED DESCRIPTION

Figure 1:
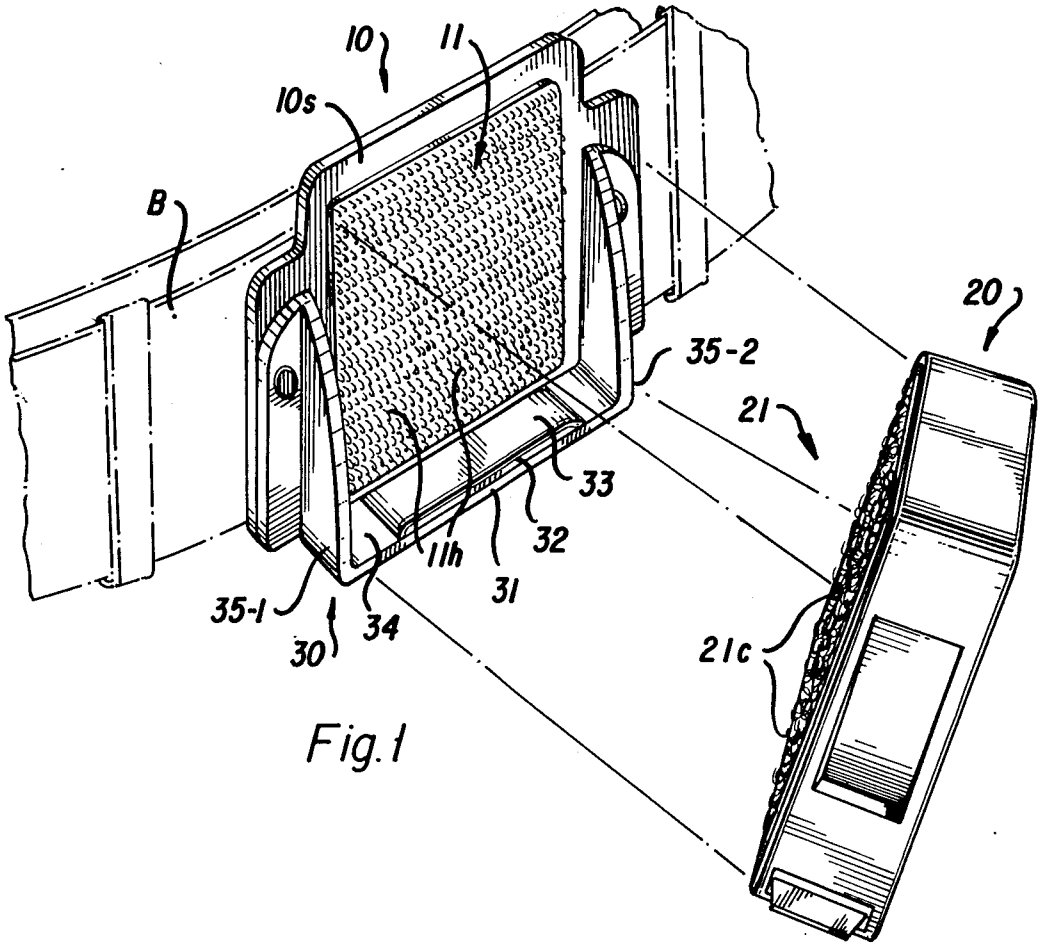
FIG. 1 is a perspective view of a quick release retainer in accordance with the invention, showing a work piece in a transitory state.

With reference to the drawings, a quick release retainer or receptor 10 is shown in FIG. 1 attached to a item of apparel in the form of a belt B. The retainer 10 provides for the quick release storage of a work piece such as a tape measure 20. The tape measure 20 in FIG. 1 is in the course of either being removed from the quick release retainer 10 or returned to the retainer after use. As seen in FIG. 1 the retainer 10 includes an attachment member 11 that occupies the major portion of the retainer surface 10*s*. A complimentary material 21 for the attachment member 11 overlies the reverse surface of the tape measure 20. As indicated in FIG. 1 the attachment member 11 includes a multiplicity of tiny hooks 11*h* which are engagable with the loosely woven cover 21*c* of the complimentary member 21 on the work piece 20. A suitable hook and fabric compliment is provided by the material that is marketed and sold under the name VELCRO. Alternative materials are usable as well, for example, modern reusable adhesives may be employed which have the property of permitting multiple readhesions of an adhesive back support. For such embodiments it is desirable to include the adhesive in side-by-side panels which are exposed only after the tackiness of previously exposed panels as fallen below desired threshold of retention. In general, any complimentary contact materials can be used to implement the invention.

As further indicated in FIG. 1, the retainer 10 also includes a guard structure 30. This is provided by a base 31 with a partial lip 32. In the embodiment of FIG. 1 lip 32 is at the front surface of a platform 33 that holds the base 23 of the work piece 21 above the lower most position 34 of the guard 30. It will be understood that in some embodiments the lip 32 acts as a retainer and the platform 33 is omitted. In some cases the platform 33 is a void to permit the user to apply finger pressure at and through the base of the guard 30.

To facilitate the quick release of the work piece 20 from the retainer 10, the guard includes sloping adjoining sides 35-1 and 35-2. The slope is desirably parabolic to facilitate the removal of the work piece and simultaneously guard against inadvertent removal.

Figure 2:
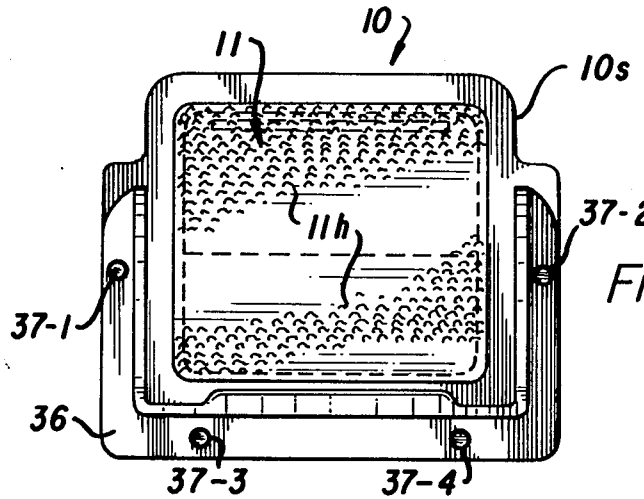
FIG. 2 is a frontal view of the quick release retainer of FIG. 1.

Once the work piece 20 is returned to the retainer 10 so that the attachment member 11 engages the complementary member 21 the work piece 20 is securely held against the attachment member 11. If the work piece is above the lip 32 it can be seated against the platform 33, or against the base position 34 when the platform 33 is omitted by applying downward pressure against the work piece 20 until it is securely seated. To remove the work piece 20, once seated, the top portion of the work piece 20 is pivoted upwardly with respect to the lip 32. In this process, the hand of the user is guided by the parabolic side surfaces 35-1 and 35-2. Further details of the retainer 10 are provided in FIGS. 2 and 3. The guard 30 is secured to the retainer surface 10*s* by a margin 36 to which fasteners such as rivots 37-1 through 37-4 are applied.

Figure 3:
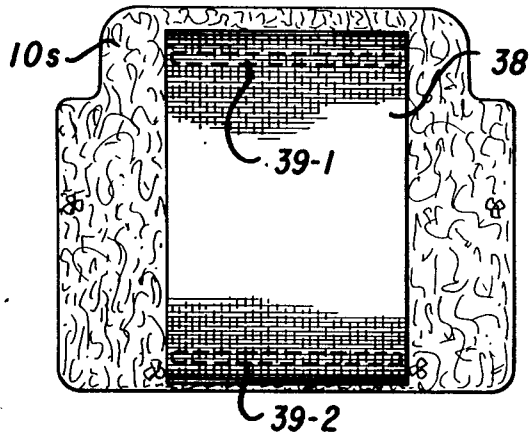
FIG. 3 is a rear view of the quick release retainer of FIG. 2.

In the rear view of the retainer as indicated in FIG. 3, the retainer surface 10*s* is provided on its reverse side with a belt loop 38 that is held to the retainer surface 10*s* by suitable stiching 39-1 and 39-2. Thus, in the view of FIG. 1 B has been threaded between the loop 38 and the reverse side 10*s* of the retainer.

Figure 5:
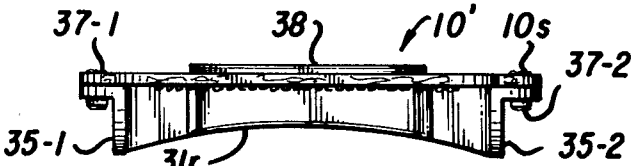
FIG. 5 is a top view for the quick release retainer of FIG. 4.
Figure 4:
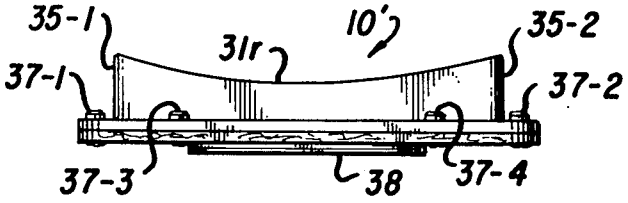
FIG. 4 is a bottom view of an alternative embodiment for the quick release retainer of FIG. 1.

A modified embodiment 10 prime is shown in the top and bottom views of FIGS. 4 and 5. In these Figures the base 31 of the guard 30 has a curved rim 31*r*. This facilitates both the return of the work piece to the retainer and its subsequent removal.

Figure 6:
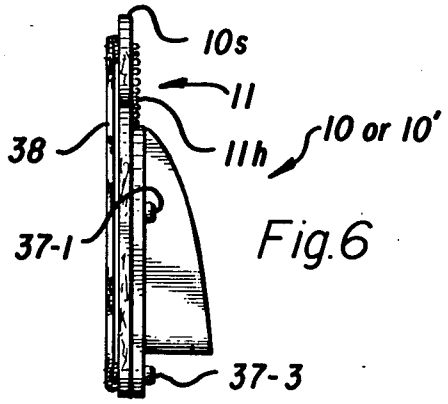
FIG. 6 is a side view of a quick release retainer in accordance with the invention.

Finally FIG. 6 is a side view of the retainer 10 or 10 prime showing the parabolic outline of the side surface 35-1.

Other aspects of the invention will be apparent to those of ordinary skill in the art. The foregoing description is for illustration only and suitiable modifications can be made without departing from the scope and spirit of the invention.

I claim:

1. A quick release retainer for a work piece, which comprises:

a receptor for the work piece;

means for attaching the receptor to a user;

means for attaching the work piece to the receptor by contact;

means for guarding against accidental separation of said work piece from said receptor, comprising a guard which partially encloses said work piece when positioned on said receptor completely protecting a base portion of said work piece and partially protecting the adjoining sides thereof;

said guard including side guards extending parabolically and partially on the adjoining sides of said work piece sloping gradually to the base thereof to the point of connection of said guard on said receptor; and said guard containing a raised portion in the base thereof to enhance the ability of the user to grasp the device; and thereby to facilitate the removal of said work piece from said receptor when the work piece is to be placed in use and simultaneously guard against inadvertent and accidental removal of said work piece from said receptor.

2. A quick release retainer as defined in claim 1 wherein said guard includes a lip which further protects against the accidental removal of said work piece from said separator, said lip being positioned along the base portion of said guard.

3. A quick release retainer as defined in claim 1 wherein said base portion includes an elevated central region and depressed side regions so that when said work piece is inserted in said retainer, the bottom of said work piece rests on said central region and the bottom edges of said work piece are elevated above said depressed side region;

thereby to facilitate the quick release removal of said work piece from said retainer.

4. A quick release retainer as defined in claim 3 wherein the central region of said base is apertured to further facilitate the quick release removal of said work piece from said retainer, with the associated structure serving to prevent or inhibit the accidental release of said work piece from said retainer.

5. Apparatus as defined in claim 4 wherein said receptor includes a frontal face with a surface that is able to make engaging and secure contact with said work piece.

6. Apparatus as defined in claim 5 wherein the engagement with said work piece is made by an adherent medium.

7. Apparatus as defined in claim 6 wherein said adherent medium is engagable with a complementary medium secured to said work piece.

8. Apparatus as defined in claim 7 wherein said adherent medium comprises a set of fabric hooks.

9. Apparatus as defined in claim 8 wherein the complementary adherent medium on said work piece comprises a fabric which is engagable by said fabric hooks.

10. Apparatus as defined in claim 1 wherein said receptor has a guard flange that partially surrounds the base of said receptor and the base of said flange is curved to enhance the security retention of said work piece in said receptor.

* * * * *